US007856688B2

(12) United States Patent
Dockendorf

(10) Patent No.: US 7,856,688 B2
(45) Date of Patent: Dec. 28, 2010

(54) CONVERTIBLE PILLOW SYSTEM AND ASSOCIATED METHODS

(76) Inventor: Annemarie V. Dockendorf, 3740 Brennan Dr., Melbourne, FL (US) 32934

( * ) Notice: Subject to any disclaimer, the term of this patent is extended or adjusted under 35 U.S.C. 154(b) by 487 days.

(21) Appl. No.: 11/737,941

(22) Filed: Apr. 20, 2007

(65) Prior Publication Data

US 2007/0245494 A1 Oct. 25, 2007

Related U.S. Application Data

(63) Continuation-in-part of application No. 11/563,254, filed on Nov. 27, 2006, now Pat. No. 7,549,183.

(60) Provisional application No. 60/784,600, filed on Mar. 22, 2006, provisional application No. 60/787,269, filed on Mar. 30, 2006, provisional application No. 60/839,553, filed on Aug. 23, 2006.

(51) Int. Cl.
*A47D 7/00* (2006.01)

(52) U.S. Cl. ..... 5/655; 5/657; 5/652; 5/425

(58) Field of Classification Search ..... 5/417, 5/420, 636, 640, 652, 655, 657, 657.5, 425, 5/427, 98.1
See application file for complete search history.

(56) References Cited

U.S. PATENT DOCUMENTS 2,626,407 A * 1/1953 Kurry ..... 5/99.1
5,035,013 A 7/1991 Bloom
5,088,139 A 2/1992 Bloom
5,103,514 A * 4/1992 Leach ..... 5/417
D330,139 S 10/1992 Bloom
6,026,525 A * 2/2000 Davis ..... 5/99.1
6,199,230 B1 * 3/2001 Parikh ..... 5/420
6,408,463 B1 6/2002 Palacio
6,754,924 B1 6/2004 Brady et al.
6,763,539 B1 7/2004 Bartley et al.
6,920,655 B2 * 7/2005 Mitchell ..... 5/417
7,055,196 B2 6/2006 Littlehorn
7,127,760 B2 10/2006 Bartley et al.
7,549,183 B2 * 6/2009 Dockendorf et al. ..... 5/655

OTHER PUBLICATIONS

The Bean Maternity Pillow distributed by the Comfort Store www.sitincomfort.com.
Pregnancy Body Pillow distributed by One-Stop Baby www.onestopbaby.com.

* cited by examiner

*Primary Examiner*—Michael Trettel

(57) ABSTRACT

A convertible pillow system includes an enclosing bottom member moveable between folded and unfolded positions, and at least one bumper member carried by the enclosing bottom member. The enclosing bottom member may have a substantially arcuate shape. Further, the enclosing bottom member and the at least one bumper member may form an enclosed area when the enclosing bottom member is in the unfolded position. The enclosing bottom member and the at least one bumper member may form a pillow when the enclosing bottom member is in the folded position. The least one bumper member includes a first portion that is fixedly connected to the enclosing bottom member, and a second portion that is detachably connected to the enclosing bottom member.

25 Claims, 14 Drawing Sheets

CONVERTIBLE PILLOW SYSTEM AND ASSOCIATED METHODS

RELATED APPLICATIONS

This application is a continuation-in-part application of U.S. patent application Ser. No. 11/563,254 filed Nov. 27, 2006 and now U.S. Pat. No. 7,549,183, the contents of which are incorporated herein by reference and which claims the benefit of U.S. Provisional Patent Application Ser. No. 60/784,600 filed on Mar. 22, 2006, the contents of which are incorporated herein by reference in its entirety, and is related to U.S. Provisional Patent Application Ser. No. 60/787,269 filed on Mar. 30, 2006, and U.S. Provisional Patent Application Ser. No. 60/839,553 filed on Aug. 23, 2006, the contents of both of which are also incorporated herein by reference in their entireties.

FIELD OF THE INVENTION

The present invention relates to the field of pillows and infant play areas and, more particularly, to the field of pillows that are convertible to infant play areas, and related methods.

BACKGROUND OF THE INVENTION

During pregnancy, a woman may require additional support adjacent the belly area while sleeping. More specifically, the enlarged belly of a pregnant woman may cause discomfort while sleeping. Accordingly, several maternity or body pillows exist to provide some support adjacent the belly of a pregnant women. For example, U.S. Pat. No. 7,055,196 to Littlehorn discloses a pregnancy support pillow.

Another such pillow, for example, is distributed by "The Comfort Store" under the tradename "The Bean Maternity Pillow". This pillow includes a pair of smaller pillows that are connected to one another using a hood and loop fastener. One of the pair of pillows is to be positioned adjacent the belly of the user, and the other pillow is to be positioned adjacent the lower back of the user. The positioning of the pair of pillows is intended to provide support to the belly and lower back of the user. The positioning of the pair of pillows is intended to provide support to the belly and lower back of the pregnant woman.

Another such pillow, for example, is distributed by "One-Stop Baby" under the tradename "Pregnancy Body Pillow". This pillow includes a pair of elongate pillows that are connected to one another using a hook and loop fastener. The pair of pillows are to be positioned to extend adjacent the length of the user so that the pillows may support the belly portion and rear of the pregnant woman.

These pillows may, however, not have a use to the woman after her pregnancy is over. Therefore, the user is required to find storage space for the pillows when not in use. This may be a greater issue for the "Pregnancy Body Pillow" as it includes elongate pillows.

After the infant is born, parents may find it necessary to provide an enclosed area within which the infant may sleep or play. In cases when a family is traveling, and also in cases when a crib or play pen may not be available, parents sometimes place the infant in what may be considered improper, and sometimes unsafe, enclosed areas. For example, some parents may lay the infant on a bed, and form an enclosed area using pillows.

Some portable play areas exist to provide parents with an enclosed area to be used for the infant. For example, U.S. Pat. No. 5,035,013 to Bloom discloses a foldable infant play mat.

The foldable infant play mat includes a base and a circular pillow carried by the base. The circular pillow may be removed from the base, as illustrated, for example, in FIG. 6. The base may be folded and the circular pillow enclosed therein to form a semi-circular folded play mat to be transported by the user.

U.S. Pat. No. 5,088,139, also to Bloom discloses a portable play mat and carrying case. The play mat includes a circular base, and a circular pillow carried by the base. The carrying case is stitched to the base along the bottom and provides a pocket within which the circular base and the circular pillow may be positioned. The carrying case includes a zipper closure and a handle.

U.S. Pat. No. 6,408,463 to Palacio discloses a baby play mat having a base and removable bumpers. The removable bumpers are carried by an upper portion of the base and may be connected to one another using hook and loop fasteners. The bumpers may be stacked to provide greater height to the enclosed area. Such a play area, however, may be cumbersome to transport, and may be complicated to assemble.

It may also be advantageous to provide a support for a mother to use while breastfeeding an infant. Such supports are disclosed, for example, in U.S. Pat. Nos. 6,763,539 and 7,127,760. These pillows include a medial region and two opposing arms to be positioned adjacent a mother's midsection so that an infant may be rested on the pillow to support the infant during nursing. Such pillows are only truly useful, however, during nursing.

Accordingly, there exist elongate pillows and play areas. Therefore, a pregnant woman may require the use of an elongate maternity pillow during her pregnancy, and will likely require storage space for the pillow after her pregnancy is completed. Thereafter, after the infant is born, parents may purchase a portable play area for the infant. This is disadvantageously cost ineffective, and requires still further storage space.

SUMMARY OF THE INVENTION

In view of the foregoing background, it is therefore an object of the present invention to provide a convertible pillow system that advantageously provides support to a pregnant woman during her pregnancy and provides a portable enclosed area to be used by an infant. It is also an object of the present invention to provide an enclosed area that may be readily converted to a pillow, and vice versa.

It is further an object of the present invention to provide a convertible pillow system that may be used as a nursing pillow. It is also an object of the present invention to provide a convertible pillow system that may be used as an infant support pillow. It is still further an object of the present invention to provide a convertible pillow system that is readily washable. It is yet another object of the present invention to provide a convertible pillow system that allows for the transport of items associated with the care of an infant.

These and other objects, features, and advantages in accordance with the present invention are provided by a convertible pillow system including an enclosing bottom member that is movable between folded and unfolded positions, and a bumper member carried by the enclosing bottom member. The enclosing bottom member preferably has a substantially arcuate shape. Further, the enclosing bottom member and the bumper member form an enclosed area when the enclosing bottom member is in the unfolded position. The enclosed area may have a bottom defined by the enclosing bottom member and a sidewall defined by the bumper member connected to and overlying outer-peripheral portions of the enclosing bottom member.

The enclosing bottom member and the bumper member may form a pillow when the enclosing bottom member is in the folded position. The pillow may have an outer lining portion defined by the enclosing bottom member, and an inner portion defined by the bumper member. The bumper member includes a first portion that is fixedly connected to the enclosing bottom member, and a second portion that is detachably connected to the enclosing bottom member.

The bumper member may be foldable. Further, the bumper member may include a pair of bumper members joined together by at least one seam. The pair of bumper members may include a first bumper member, having a first predetermined length and a second bumper member, having a second predetermined length. The first predetermined length is preferably longer than the second predetermined length.

The substantially arcuate shape of the enclosing bottom member is preferably circular. The bumper member also preferably has a circular shape so that the enclosed area is a substantially enclosed circular area.

The first portion of the bumper member is preferably fixedly connected to the enclosing bottom member by stitched connection. The second portion of the bumper member is preferably detachably connected to the enclosing bottom member by a hook and loop fastener. The convertible pillow system may also include a lining overlying the enclosing bottom member. The lining advantageously enhances comfort of the enclosed area when the enclosing bottom member is in the unfolded position.

The system may also include a pocket carried by the enclosing bottom member. The pocket may be positioned along an interior portion of the pillow when the enclosing bottom member is positioned in the folded position. The pocket preferably includes a pocket closure that may be defined by a zipper. Accordingly, the pocket advantageously allows a user to store items associated with the care of an infant when the enclosing bottom member is in the folded position.

The system may also advantageously include an auxiliary pillow carried within the enclosing bottom member when the enclosing bottom member is in the folded position. The auxiliary pillow is preferably removable when the enclosing bottom member is in the unfolded position. The auxiliary pillow may advantageously be used to support the infant when positioned within the enclosed area.

The system may also include a closure device connected to an outer peripheral portion of the enclosing bottom member. The closure device is preferably movable between opened and closed positions. The closure device may be provided by a zipper or a plurality of snap fasteners. The system may also include a handle fixedly connected to an outer peripheral portion of the enclosing bottom member.

The present invention also advantageously includes a convertible pillow kit. The convertible pillow kit comprises a carrying device, the convertible pillow system discussed above removably carried by the carrying device, and printed material removably carried by the carrying device.

A method aspect of the present invention is for using a convertible pillow system. The method may include moving the enclosing bottom member from the folded position defining a pillow, to the unfolded position defining the enclosed area. The method may further include moving the enclosing bottom member from the unfolded position defining the enclosed area to the folded position defining the pillow.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
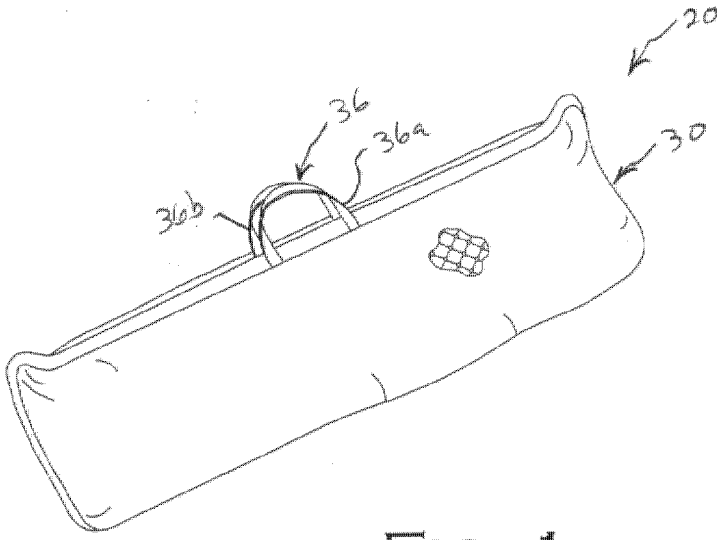
FIG. 1 is a front perspective view of a combination pillow and enclosed area system according to the present invention.
Figure 2:
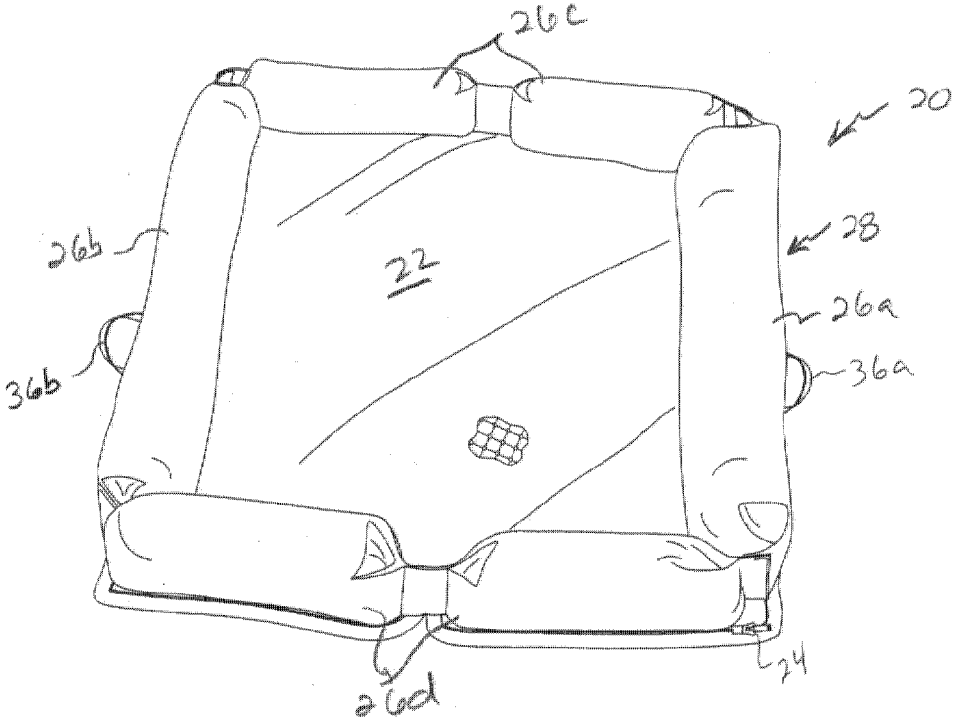
FIG. 2 is a perspective view of the combination pillow and enclosed area system illustrated in FIG. 1 showing an enclosing bottom member in an unfolded position.

Referring initially to FIGS. 1 and 2, the combination pillow and enclosed area system 20 according to the present invention is now described in greater detail. The system 20 illustratively includes an enclosing bottom member 22 that is moveable between folded and unfolded positions. The enclosing bottom member 22 includes a closure device 24 connected to an outer peripheral portion thereof. The closure device 24 is moveable between open and closed positions.

The system 20 also includes a plurality of bumper members 26 that are carried by the enclosing bottom member 22. As perhaps best illustrated in FIG. 2, the plurality of bumper members 26 are preferably positioned adjacent the outer peripheral portions of the enclosing bottom member 22 when the enclosing bottom member is in the unfolded position.

As further illustrated in FIG. 2, the enclosing bottom member 22 and the plurality of bumper members 26 form an enclosed area 28 when the enclosing bottom member is in the unfolded position. The enclosed area 28 has a bottom defined by the enclosing bottom member 22 and a plurality of side walls defined by the plurality of bumper members 26 connected to and overlying the outer peripheral portion of the enclosing bottom member. The enclosed area 28 may advantageously be used as an infant play area, for example, or an area in which a parent may lay an infant to sleep or rest.

As perhaps best illustrated in FIG. 1, the enclosing bottom member 22 and the plurality of bottom members 26 may form a pillow 30 when the enclosing bottom member is in the folded position. The pillow 30 has an outer lining portion defined by the enclosing bottom member 22 and an inner portion defined by the plurality of bumper members 26. Therefore, the combination pillow and enclosed area system 20 of the present invention advantageously provides a pregnant woman with a pillow 30 for support during her pregnancy, and an infant with an enclosed area 28. Accordingly, the pillow 30 will have a use after the woman's pregnancy has been completed, and does not require storage. Further, the pillow is preferably of a shape and size that allows a user to readily use it for any other support purpose, e.g., head and neck support.

Figure 3:
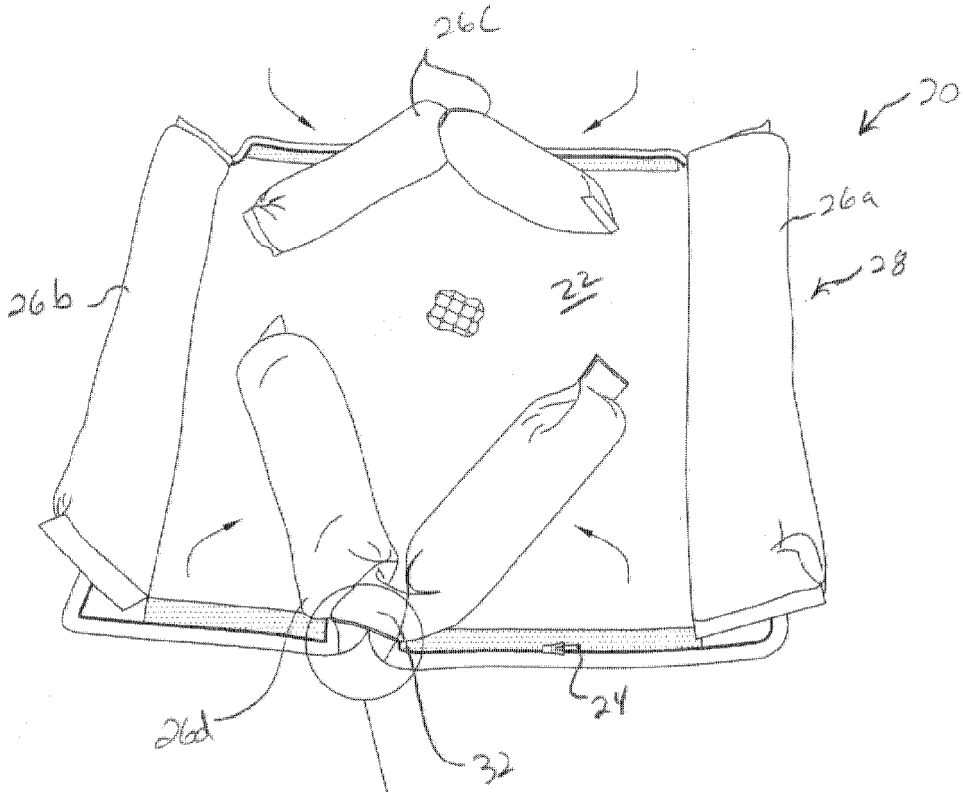
FIG. 3 is a perspective view of one embodiment of the combination pillow and enclosed area system having the enclosing bottom member being moved from the unfolded position to the folded position.
Figure 4:
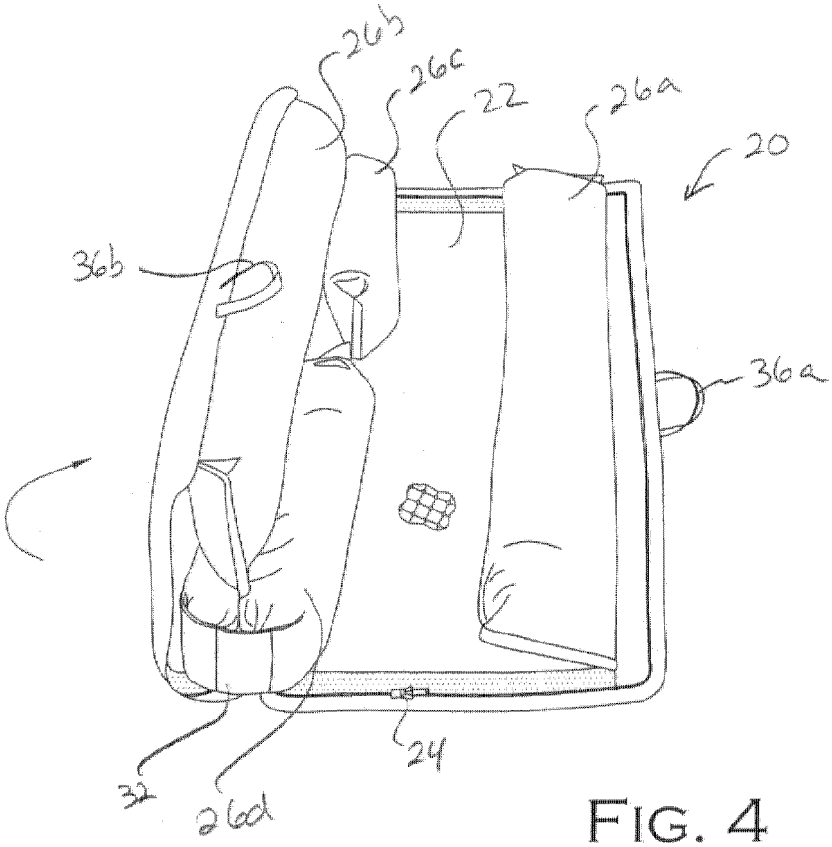
FIG. 4 is a perspective view of one embodiment of the combination pillow and enclosed area system having the enclosing bottom member being moved from the unfolded position to the folded position.
Figure 5:
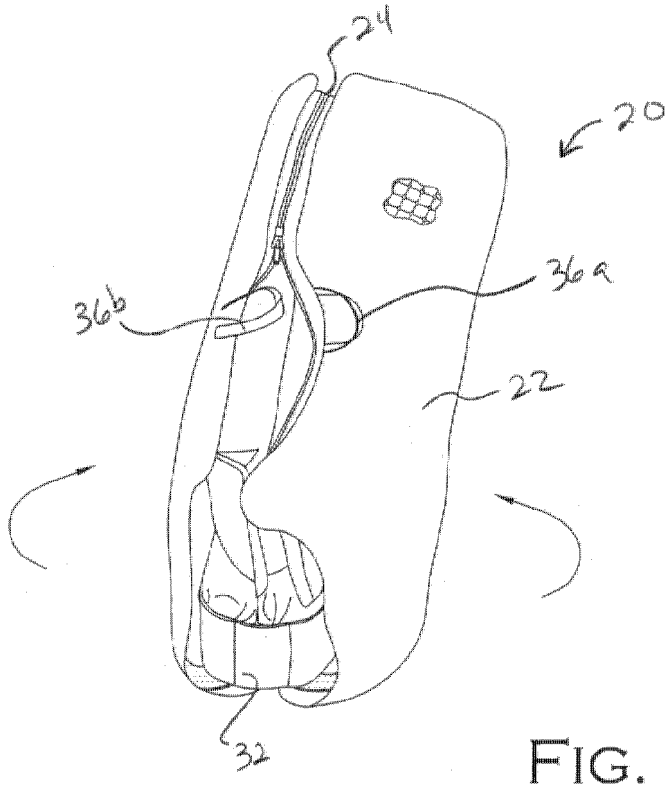
FIG. 5 is a perspective view of the combination pillow and enclosed area system illustrated in FIGS. 3-4 having a closure device being moved from an open position to a closed position to form a pillow.

Referring now additionally to FIGS. 3-5, the combination pillow and enclosed area system 20 is described in greater detail. The plurality of bumper members 26 illustratively includes a first 26*a*, second 26*b*, third 26*c*, and fourth 26*d* bumper member. Each of the plurality of bumper members 26*a*, 26*b*, 26*c*, 26*d*, may be fixedly connected to an outer peripheral portion of the enclosing bottom member 22. More specifically, the plurality of bumper members 26*a*, 26*b*, 26*c*, 26*d*, may be fixedly connected to the enclosing bottom member 22 by a sewn connection. Those skilled in the art will appreciate that the bumper members 26*a*, 26*b*, 26*c*, 26*d*, are fixedly connected to the enclosing bottom member 22 in a manner that does not allow for the bumper members to be readily removed from the enclosing bottom member 22. A sewn connection is preferred, but other connections that allow for the plurality of bumper members 26*a*, 26*b*, 26*c*, 26*d*, to be fixedly connected to the enclosing bottom member 22 may also be used, as understood by those skilled in the art.

Figure 3A:
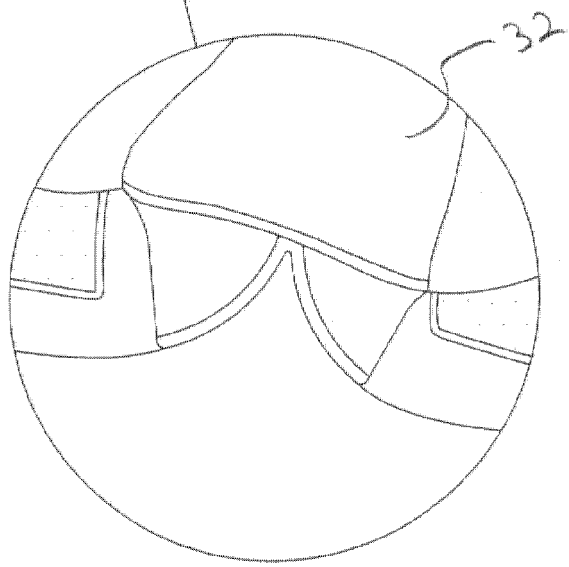
FIG. 3*a* is a blow up of a portion of the combination pillow and enclosed area system showing a seam between the bumper members.

As perhaps best illustrated in FIG. 3, the first and second bumper members 26*a*, 26*b*, have a first predetermined length. The predetermined length of the first and second bumper members 26*a*, 26*b* is preferably substantially similar to the length of the outer peripheral portion of the enclosing bottom member 22 positioned adjacent the respective bumper member. The third and fourth bumper members 26*c*, 26*d* each illustratively comprise a pair of bumper members. Each one of the bumper members in the pair of bumper members have a second predetermined length that is shorter than the first predetermined length. The pair of bumper members in the third and fourth bumper members 26*c*, 26*d*, are preferably joined together by a seam 32. Additional detail of the seam 32 is illustrated, for example, in FIG. 3*a*. The third and fourth bumper members 26*c*, 26*d* are foldable along the seam 32.

Operation of this embodiment of the combination pillow and enclosed area system 20 is now described in greater detail. In this embodiment, the first and second bumper members 26*a*, 26*b* are fixedly connected to opposing outer peripheral portions of the bottom enclosing member 22. More specifically, as reference above, the first and second bumper members 26*a*, 26*b* may be sewn or stitched to the enclosing bottom member 22. The sewn or stitched connection between the first and second bumper members 26*a*, 26*b*, preferably extends substantially the length of the bumper member.

The seam 32 of each of the third and fourth bumper members 26*c*, 26*d* are also preferably fixedly connected to opposing medial outer peripheral portions of the enclosing bottom member 22. The fixed connection between the third and fourth bumper members 26*c*, 26*d* is preferably a sewn or stitched connection that extends substantially the length of the seam 32. When converting the enclosed area 28 of the combination pillow and enclosed area system 20 to a pillow 30, the third and fourth bumper members 26*c*, 26*d* fold inwardly along the seam 32 towards a medial portion of the enclosing bottom member 22. When the third and fourth bumper members 26*c*, 26*d* are folded inwardly towards the medial portion of the enclosing bottom member 22, the opposing ends of the third and fourth bumper members are illustratively positioned adjacent one another. Thereafter, the enclosing bottom member 22 may be folded so that the first and second bumper members 26*a*, 26*b* are positioned to overlie the third and fourth bumper members 26*c*, 26*d*. The enclosing bottom member 22 is folded so that the fold is adjacent the medial portion thereof.

As further illustrated in FIG. 5, after the first and second bumper members 26*a*, 26*b* have been positioned to overlie the third and fourth bumper members 26*c*, 26*d* and the enclosing bottom member 22 is moved from the unfolded position to the folded position, the closure device 24 may be moved from the open position to the closed position to thereby form a pillow 30. As further illustrated in FIG. 5, the closure device 24 is positioned on the enclosing bottom member 22 in such a way that allows material from the enclosing bottom member to cover the closure device. This advantageously allows a user to use the pillow without interference from the closure device.

Figure 6:
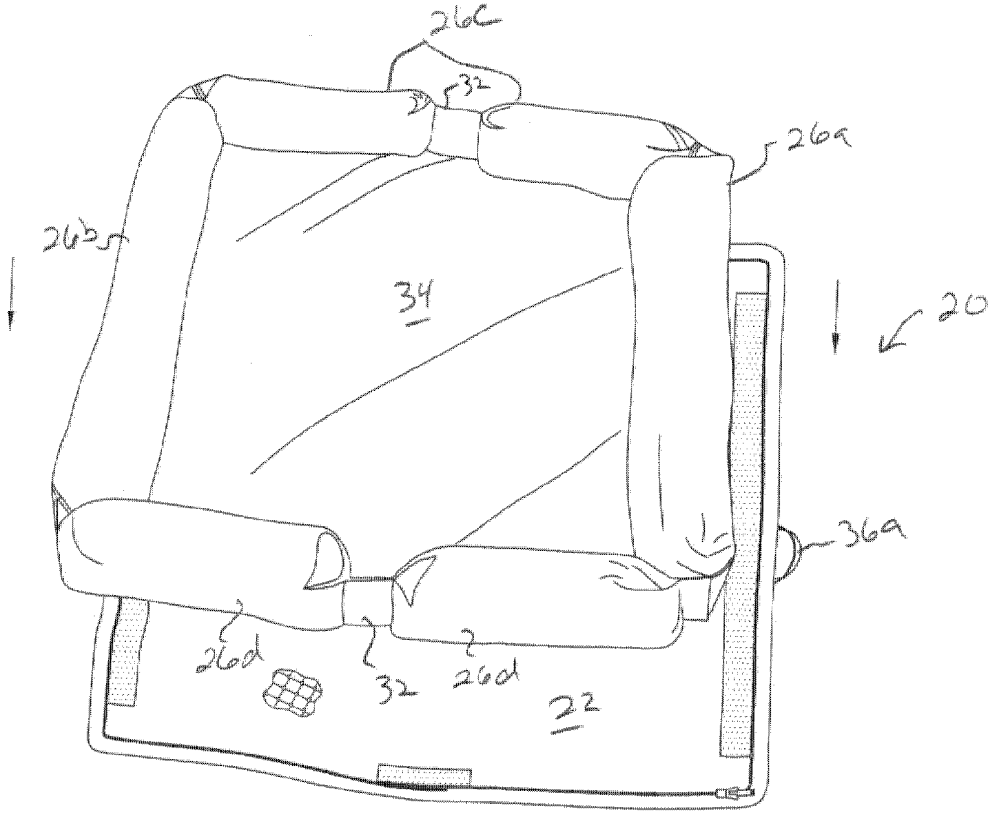
FIG. 6 is a perspective view of the combination pillow and enclosed area system illustrated in FIG. 1 having a plurality of bumper members that are detachably connected from the enclosing bottom member.

Referring now additionally to FIG. 6, the plurality of bumper members 26*a*, 26*b*, 26*c*, 26*d* are illustratively detachably connected to the outer peripheral portion of the enclosing bottom member 22. More specifically, the plurality of bumper members 26*a*, 26*b*, 26*c*, 26*d* are detachably connected to the enclosing bottom member using a plurality of hook and loop fasteners. The hook and loop fasteners are illustrated in FIG. 6 as extending substantially the length of one of the peripheral side portions of the enclosing bottom member 22 and adjacent a medial outer peripheral portion of the enclosing bottom member.

Those skilled in the art, however, will appreciate that the hook and loop fasteners may be positioned in any configuration suitable to allow the plurality of bumper members 26*a*, 26*b*, 26*c*, 26*d* to be detachably connected from the enclosing bottom member 22 using any other type of fastener suitable for allowing a user to readily connect and detach the plurality of bumper members from the enclosing bottom member.

The detachability of the plurality of bumper members 26*a*, 26*b*, 26*c*, 26*d* from the enclosing bottom member 22 advantageously allows a user to readily wash the enclosing bottom member and the plurality of bumper members in a washing machine. Of course, the material of the plurality of bumper members 26*a*, 26*b*, 26*c*, 26*d* and the enclosing bottom member 22 are preferably a machine washable material, but those skilled in the art will appreciate that the material of the enclosing bottom member and the plurality of bumper members may be any other material suitable for use in the combination pillow and enclosed area system 20.

Figure 7:
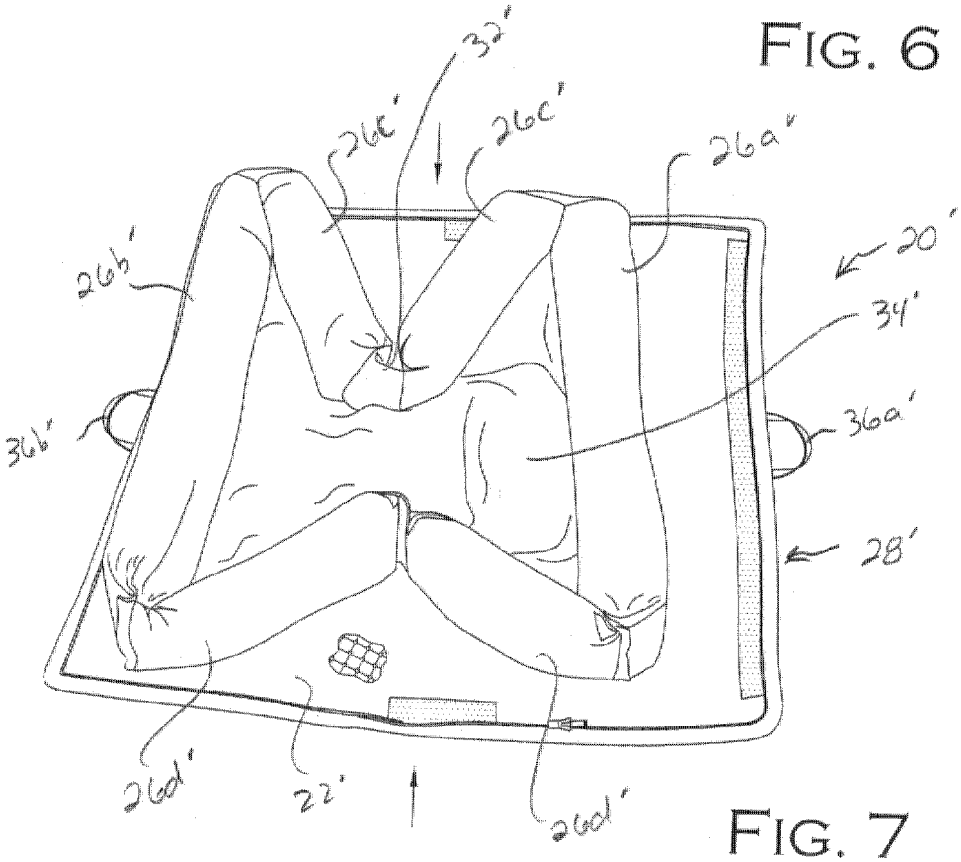
FIG. 7 is a perspective view of another embodiment of the combination pillow and enclosed area system showing the enclosing bottom member being moved from the unfolded position to the folded position.
Figure 8:
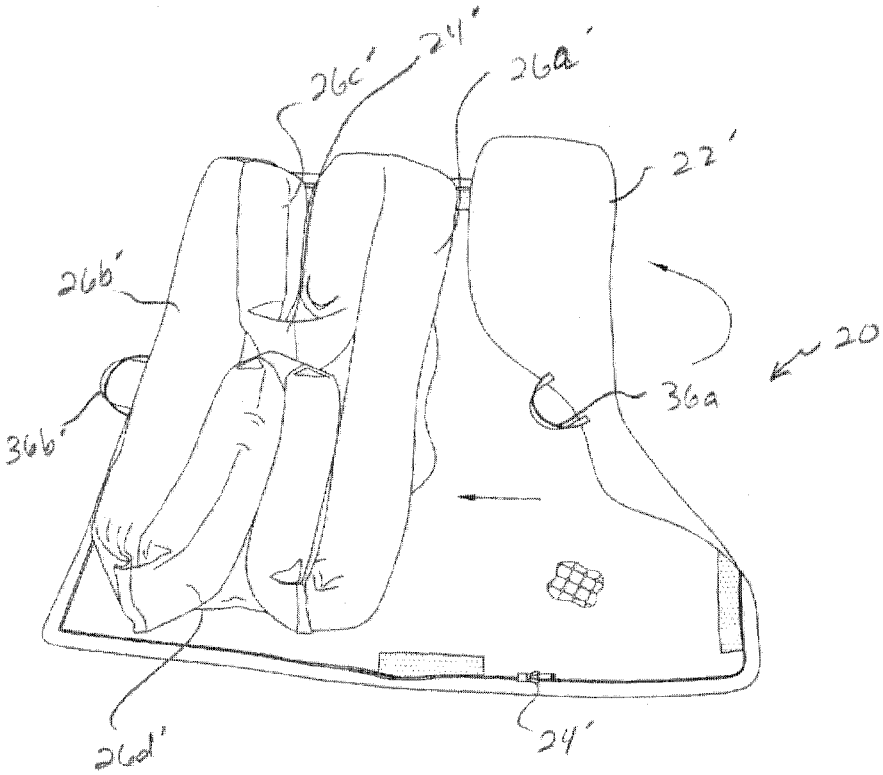
FIG. 8 is a perspective view of another embodiment of the combination pillow and enclosed area system showing the enclosing bottom member being moved from the unfolded position to be folded position.
Figure 9:
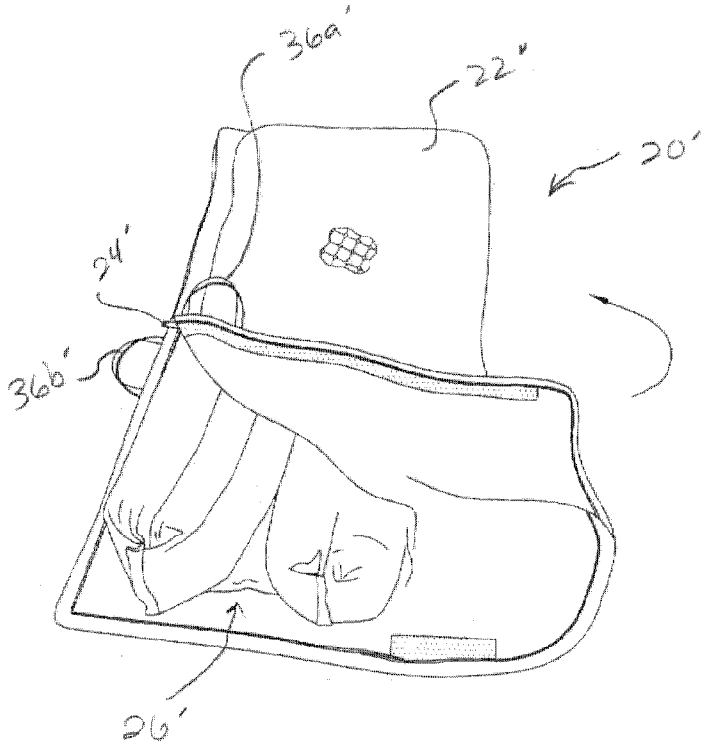
FIG. 9 is a perspective view of the combination pillow and enclosed area system illustrated in FIGS. 7-8 having the closure device being moved from the opened to the closed positions.

Referring now additionally to FIGS. 7-9, another embodiment of the combination pillow and enclosed area system 20' is now described in greater detail. In this embodiment of the system 20', the first bumper member 26*a*' is a fixedly connected to the outer peripheral portion of the enclosing bottom member 22'. The second, third and fourth bumper members 26*b*', 26*c*', 26*d*', are preferably detachably connected to the outer peripheral portions of the enclosing bottom member 22'. Similar to the first embodiment of the combination pillow and enclosed area system 20, in the second embodiment of the system 20', the first bumper member 26*a*' is preferably fixedly connected to the enclosing bottom member 22' using a sewn or stitched connection. Further, the second, third and fourth bumper members 26*b*', 26*c*', 26*d*', are preferably detachably connected to the enclosing bottom member 22' using hook and loop fasteners.

Those skilled in the art will appreciate that the first bumper member 26*a*' may also be fixedly connected to the enclosing bottom member 22' using any other type of connection. Similarly, those skilled in the art will appreciate that the second, third and fourth bumper members 26*b*', 26*c*', 26*d*', may also be detachably connected to the enclosing bottom member 22' using other types of connections, such as a snap fastener, buttons, or any other similar connection suitable for detachably connecting the second, third and fourth bumper members to the enclosing bottom member.

When the enclosing bottom member 22' is moved from the unfolded position to the folded position, the second bumper member 26*b*' illustratively slides towards the first bumper member 26*a*', and the third and fourth bumper members 26*c*', 26*d*' fold inwardly along the seams 32' to position the seams adjacent an interior medial portion of the enclosing bottom member. Accordingly, and as perhaps best illustrated in FIG. 8, the first, second, third and fourth bumper members 26*a*', 26*b*', 26*c*', 26*d*' are positioned adjacent one another when the enclosing bottom member 22' is moved from the unfolded position to the folded position.

Figure 10:
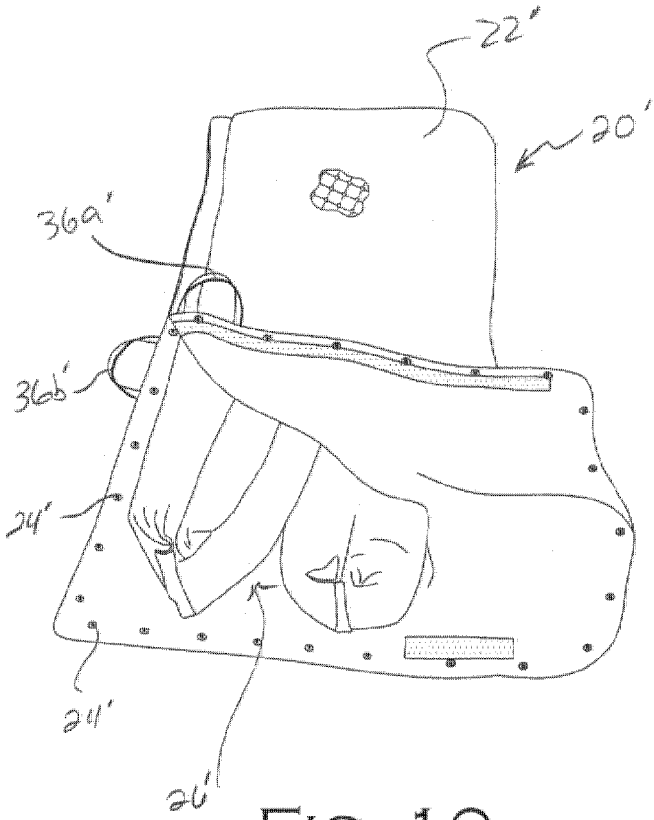
FIG. 10 is a perspective view of the combination pillow and enclosed area system illustrated in FIGS. 7-8 and having another type of closure device being moved from the open position to the closed position.

Thereafter, and as perhaps best illustrated in FIGS. 9 and 10, the closure device 24' may be moved from the open position to the closed position to form a pillow 30'. The other elements of this embodiment of the combination pillow and enclosed area system 20' are similar to those of the first embodiment of the combination pillow and enclosed area system 20, are labeled with prime notation, and require no further discussion herein.

As illustrated in FIG. 9, the closure device 24' is provided by a zipper positioned adjacent the outer peripheral portions of the enclosing bottom member 22'. As illustrated in FIG. 10, the closure device 24' may also be provided by snap fasteners. Those skilled in the art will appreciate that the closure device may also be provided by any other type of fastener suitable for securing the outer peripheral portions of the enclosing bottom member 22' to enclose the plurality of bumper members 26*a*', 26*b*', 26*c*', 26*d*' therein to thereby form a pillow 30'.

As perhaps best illustrated in FIG. 6, the combination pillow and enclosed area system 20 may also include a lining 34 overlying the enclosing bottom member 22. The lining 34 is preferably connected to each of the plurality of bumper members 26*a*, 26*b*, 26*c*, 26*d*, and provides an area upon which an infant may be laid when the combination pillow and enclosed area system 20 is positioned in the form of the enclosed area 28. The lining 34 is preferably a soft material, such as silk or satin, or any other similar material to advantageously enhance comfort for the infant. Further, the material is preferably machine washable, but those skilled in the art will appreciate that any material may be used for the lining 34.

Referring now back to FIG. 1, the combination pillow and enclosed area system 20 preferably includes a handle 36 fixedly connected to the outer peripheral portion of the enclosing bottom member 22. More specifically, the handle 36 preferably includes a pair of handle members 36*a*, 36*b* fixedly connected to opposing outer peripheral portions of the enclosing bottom member 22. Accordingly, when the enclosing bottom member 22 is in the folded position, the pair of handle members 36*a*, 36*b* are positioned adjacent one another to form a single handle 36. Further, the handle members 36*a*, 36*b*, are preferably sewn to the enclosing bottom member 22. Those skilled in the art, however, will appreciate that the handle members 36*a*, 36*b* may be fixedly connected to the enclosing bottom member 22 using any other suitable fastening means. The handle 36 advantageously enhances a user's ability to transport the combination pillow and enclosed area system 20.

Figure 11:
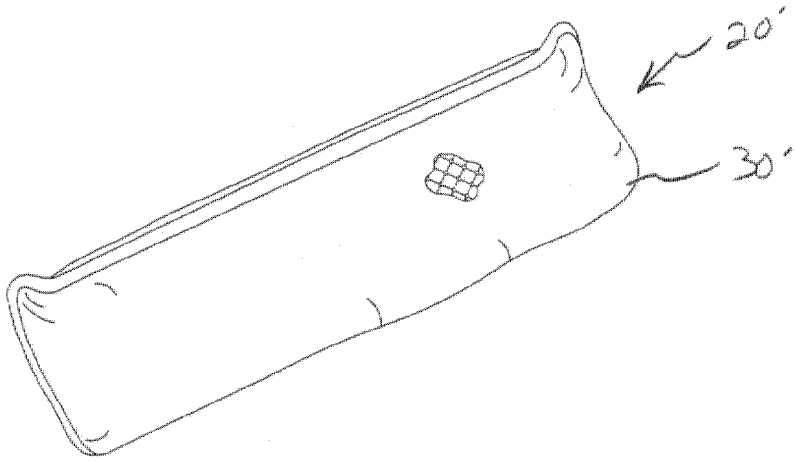
FIG. 11 is a perspective view of the combination pillow and enclosed area system in the form of a pillow.

Those skilled in the art will appreciate that the combination pillow and enclosed area system 20 may also be provided without a dangle 36, as illustrated, for example, in FIG. 11. Eliminating the handle 36 of the combination pillow and enclosed area system 20 may advantageously enhance comfort when being used as a pillow 30.

Figure 12:
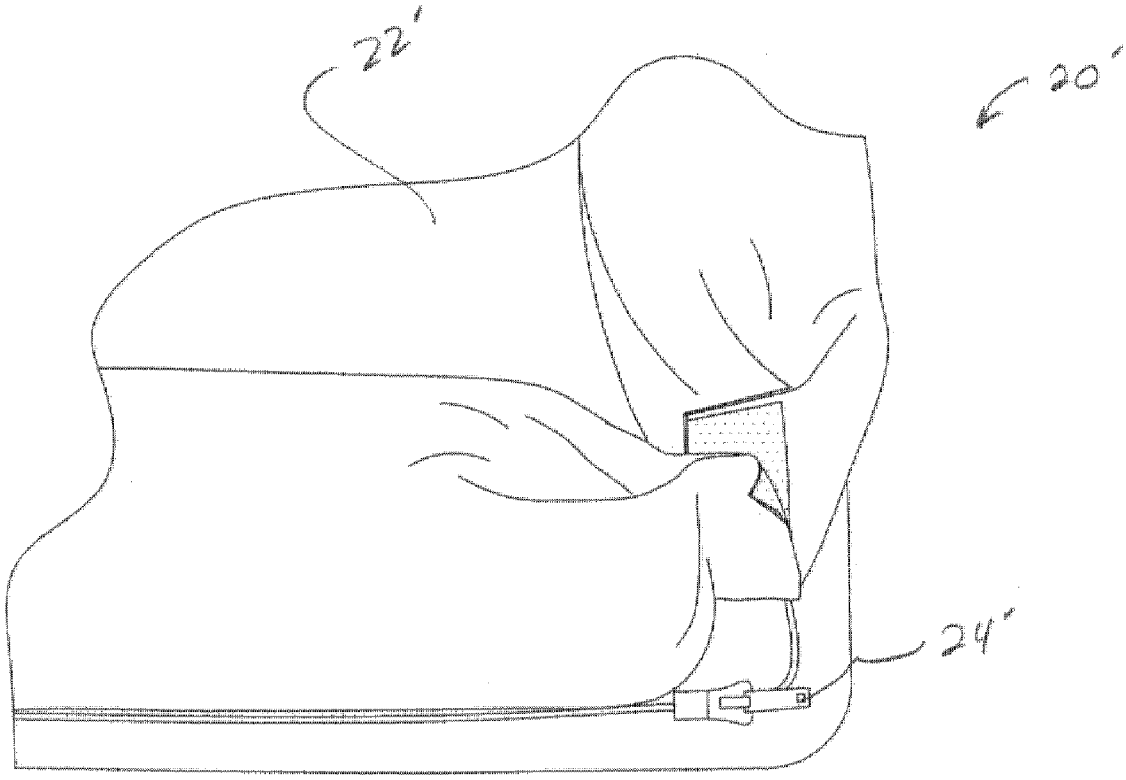
FIG. 12 is a partial perspective view of the combination pillow and enclosed area system showing the bumper members being detachably connected to one another.

Referring now back to FIG. 3 and additionally to FIG. 12, the plurality of bumper members 26 may be detachably connected to one another when the enclosing bottom member 22 is in the unfolded position. The plurality of bumper members 26 may be detachably connected to one another using a hook and loop fastener. Those skilled in the art, however, will appreciate that the plurality of bumper members 26 may be connected to one another using any other type of fastener. The positioning of the hook and loop fasteners adjacent the ends of each of the plurality of bumper members 26*a*, 26*b*, 26*c*, 26*d* is advantageous as it is less likely to be exposed when the combination pillow and enclosed area system 20 is used as an enclosed area. Accordingly, an infant laid within the enclosed area 28 is less likely to be scratched by the sometimes abrasive surface of a hook and loop fastener.

A method aspect of the present invention is for converting the combination pillow and enclosed area system 20 from an enclosed area 28 to a pillow 30, as illustrated, for example, in FIGS. 3-5. The method includes folding the third and fourth bumper members 26*c*, 26*d* inwardly toward the medial portion of the enclosing bottom member 22. The method also includes folding the enclosing bottom member 22 so that the first and second bumper members 26*a*, 26*b*, overlie the third and fourth bumper members 26*c*, 26*d* when the enclosing bottom member is moved from the unfolded to the folded position.

Another method aspect of the present invention is also for converting a combination pillow and enclosed area system 20' from an enclosed area 38' to a pillow 30', as illustrated, for example, in FIGS. 7-9. The method may include detaching the second, third and fourth bumper members 26*b*', 26*c*', 26*d*' from the outer peripheral portions of the enclosing bottom member 22' and may also include sliding the second bumper member 26*b*' toward the first bumper member 26*a*' that is fixedly connected to the outer peripheral portion of the enclosing bottom member 22'. The method further includes folding the third and fourth bumper members 26*c*', 26*d*' inwardly as the second bumper member 26*b*' is moved towards the first bumper member 26*a*' so that the first, second, third and fourth bumper members are adjacent one another when the enclosing bottom member 22' is moved to the folded position.

Figure 13:
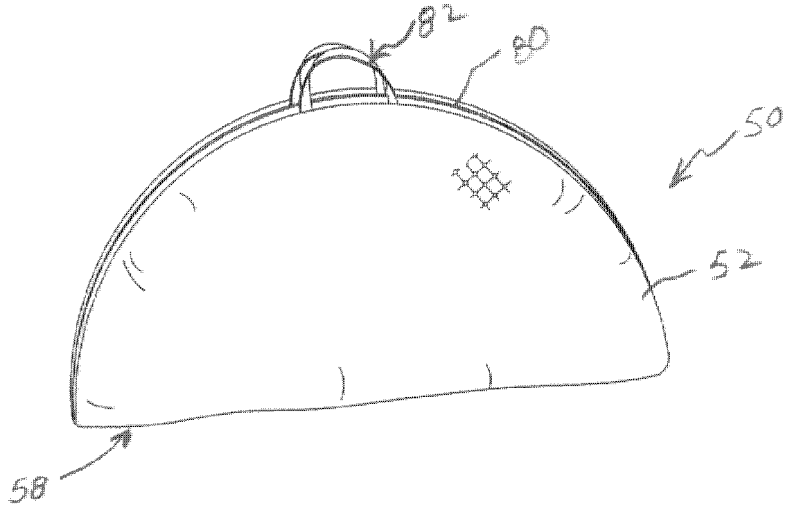
FIG. 13 is a perspective view a convertible pillow system according to the present invention showing an enclosing bottom member in a folded position.
Figure 14:
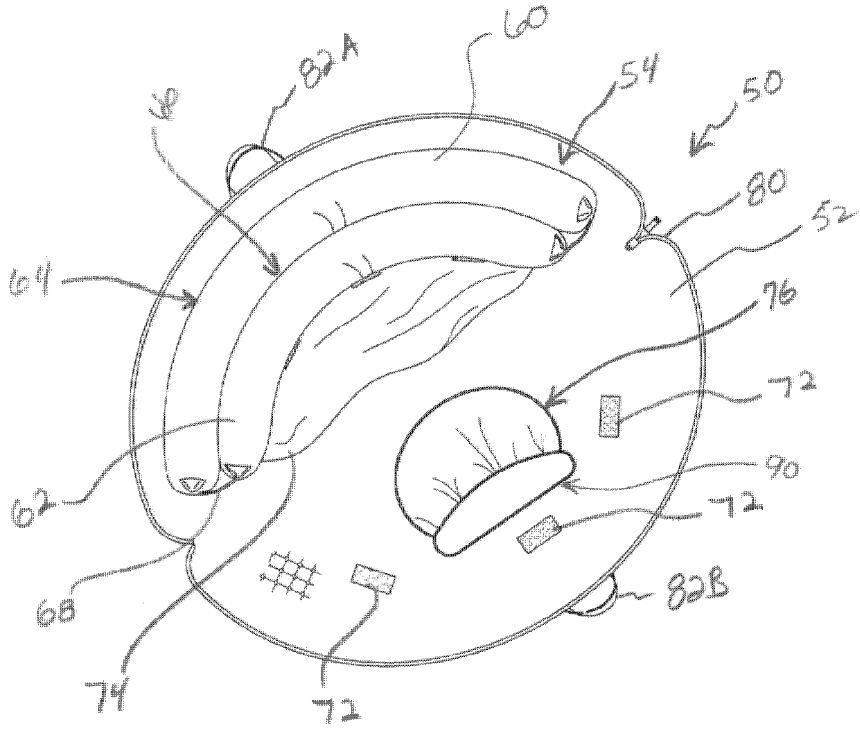
FIG. 14 is a perspective view of the convertible pillow system illustrated in FIG. 13 and showing the enclosing bottom member in an unfolded position.

Referring now, additionally, to FIGS. 13-14, a convertible pillow system 50 according to the present invention is now described in greater detail. The convertible pillow system 50 preferably includes an enclosing bottom member 52 that is moveable between folded and unfolded positions. The convertible pillow system 50 also includes a bumper member 54 carried by the enclosing bottom member 52. The enclosing bottom member 52 and the bumper member 54 form an enclosed area 56 when the enclosing bottom member is in the unfolded position. The enclosing bottom member 52 and the bumper member 54 form a pillow when the enclosing bottom member is in the folded position.

The enclosing bottom member 52 preferably has a substantially arcuate shape. Those skilled in the art, however, will appreciate that the enclosing bottom member 52 may have any other shape. More specifically, the arcuate shape of the enclosing bottom member 52 may be substantially circular.

The enclosed area 56 illustratively has a bottom defined by the enclosing bottom member 52. The enclosed area 56 also illustratively has a sidewall defined by the bumper member 54 connected to and overlying outer peripheral portions of the enclosing bottom member. More specifically, the bumper member 54 includes a first portion 60 that is fixedly connected to the enclosing bottom member 52. The pillow 58 has an outer lining portion defined by the enclosing bottom member 52. The pillow 58 also has an inner portion defined by the bumper member 54.

The convertible pillow system 50 illustrated in FIG. 13 shows the enclosing bottom member 52 in the folded position defined as a pillow 58. The convertible pillow system 50 illustrated in FIG. 14 shows the enclosing bottom member 52 in the unfolded position. The bumper member 54 is illustratively foldable. More particularly, and with reference to FIG. 14, the bumper member 54 includes a first bumper member 64 having a first predetermined length, and a second bumper member 66 having a second predetermined length.

The first predetermined length is longer than the second predetermined length. More specifically, the length of the first bumper member 64 preferably longer than the length of the second bumper member 66 so that the second bumper member may be nested within the first bumper member when the bumper is folded.

Figure 15A:
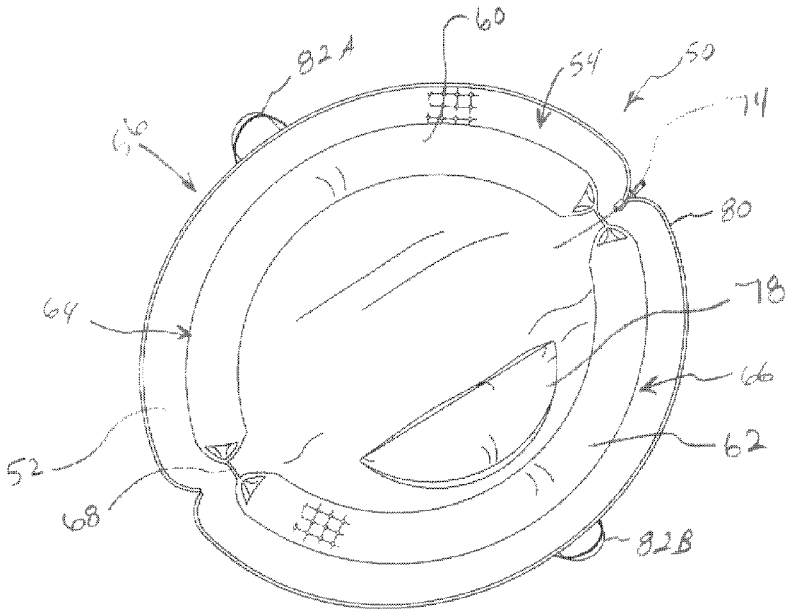
FIG. 15*a* is a perspective view of the convertible pillow system illustrated in FIG. 14 and showing a bumper member overlying the enclosing bottom member to form an enclosed area and including an auxiliary pillow.
Figure 15B:
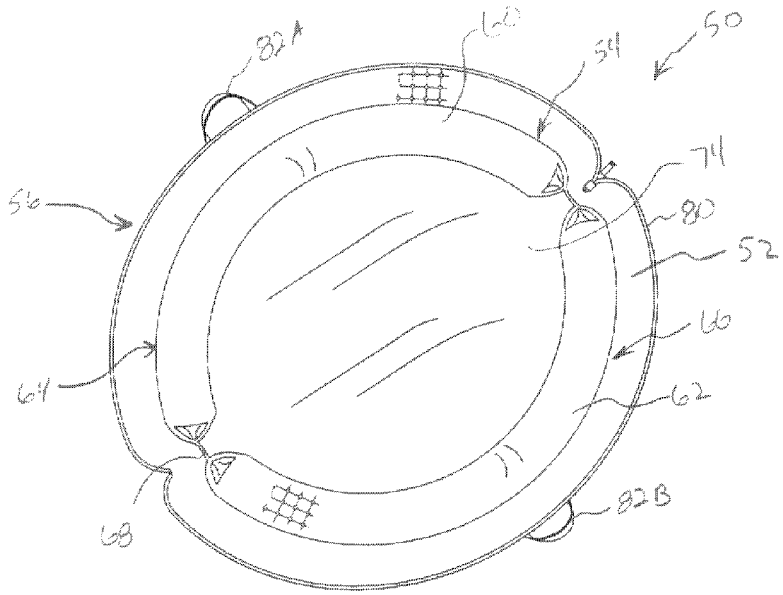
FIG. 15*b* is a perspective view of the convertible pillow system illustrated in FIG. 15*a* without the auxiliary pillow.

Referring now additionally to FIGS. 15A and 15B, additional aspects of the convertible pillow system 50 are now described in greater detail. The convertible pillow system 50 illustrated in FIGS. 15A and 15B, are shown as the enclosed area 56 formed when the enclosing bottom member 52 is in the unfolded position and the bumper member 54 is positioned to overlie the enclosing bottom member. The bumper member 54 illustratively has a substantially circular shape so that the enclosed area 56 is a substantially circular enclosed area. The bumper member 54 is illustrated as a pair of bumper members joined together by seams, 68. Those having skill in the art, however, will appreciate that the bumper member 54 may be a single continuous bumper member that is foldable to facilitate the conversion of the enclosed area 56 to a pillow 58.

Figure 16:
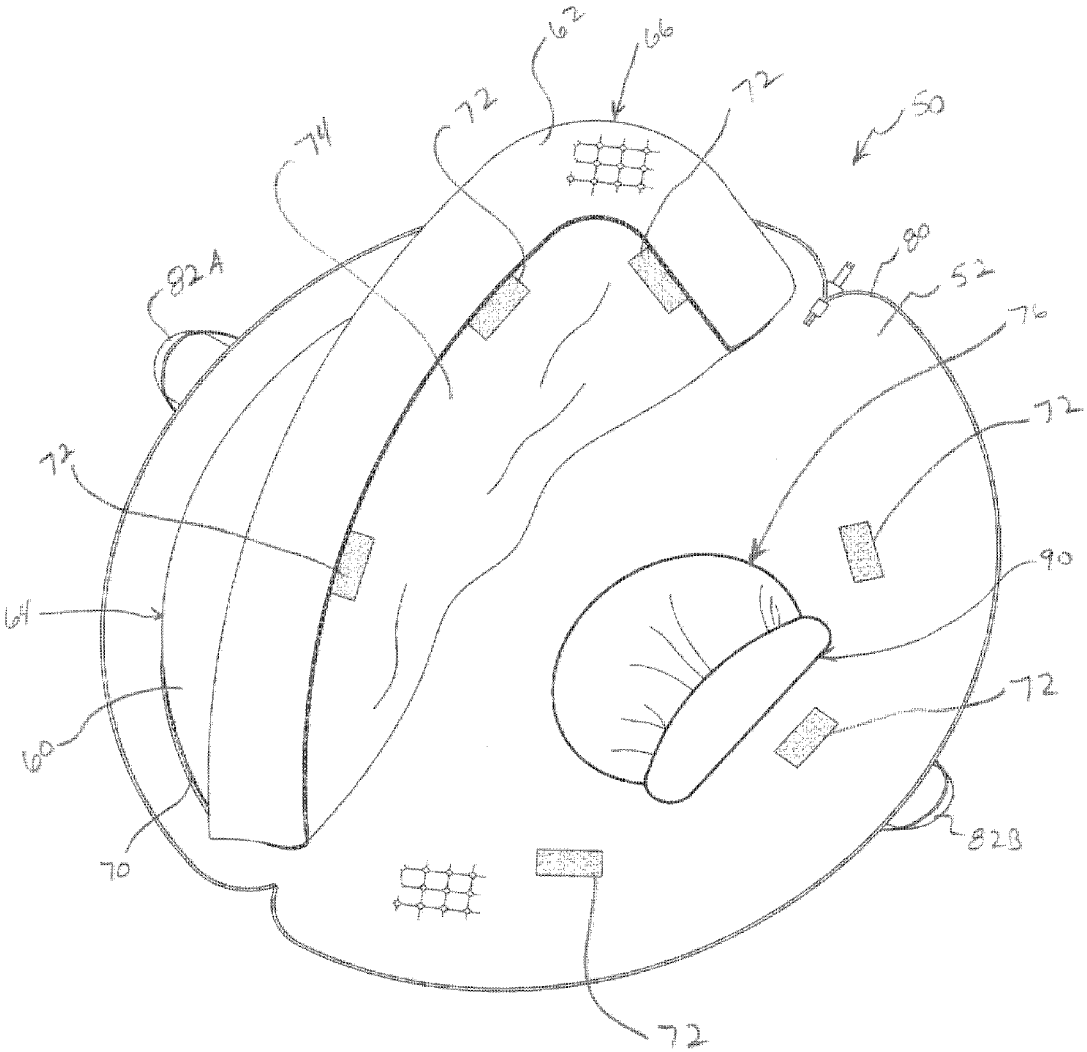
FIG. 16 is perspective view of the convertible pillow system illustrated in FIG. 15*a* and showing a pocket carried by the enclosing bottom member.

Referring now more particularly to FIG. 16, further aspects of the convertible pillow system 5C are now described in greater detail. As illustrated in FIG. 16, the first portion of the bumper member 60 is fixedly connected to the enclosing bottom member 52 by a fixed connection, such as a sewn or stitched connection 70, for example. The second portion of the bumper member 62 is preferably detachedly connected to the enclosing bottom member 52 by hook and loop fasteners.

Those skilled in the art will appreciate that the first portion of the bumper member 60 may be fixedly connected to the enclosing bottom member 52 using any other type of connection that suitably fixedly connects the bumper member to the enclosing bottom member. In other words, the present invention contemplates any connection between the first portion of the bumper member 60 and the enclosing bottom member 52 that fixedly connects the first portion of the bumper member to the enclosing bottom member.

Although three hook and loop fasteners 72 are illustrated as being used to detachedly connect the second portions of the bumper member, 62, to the enclosing bottom member 52 those skilled in the art will appreciate that any number of hook and loop fasteners 72 may be used. Further, those skilled in the art will also appreciate that any other type of fastener may be used to detachedly connect the second portion of the bumper member 66 to the enclosing bottom member 52.

The present invention also contemplates that the bumper member 54 may be completely detachably connected to the enclosing bottom member 52. More specifically, it may be advantageous for the bumper member 54 to be detachably connected to the enclosing bottom member 52 for several reasons, such as washing, replacement, or any other reason. The bumper member 54 may be completely detachably connected to the enclosing bottom member using snap fasteners, buttons, hook and loop fasteners, or any other type of connection suitable for detachably connecting the bumper member to the enclosing bottom member.

As also illustrated in FIG. 16, the convertible pillow system 50 may also include a lining 74 that is positioned to overlie the enclosing bottom member 52. The lining 74 may, for example, be a silk or satin material, or any other material suitable for providing enhanced comfort for an infant. More particularly, the lining 74 may be connected to the bumper member 54 so that the lining may be folded with the bumper member. The lining 74 is preferably fixedly connected to the bumper member 54. The fixed connection between the lining 74 and the bumper member 54 is preferably a sewn or stitched connection, but those skilled in the art will appreciate that any other type of connection may be used to fixedly connect the lining to the bumper member.

Those skilled in the art will appreciate that the lining 74 of the convertible pillow system 50 is an optional feature. More particularly, the enclosed area 56, as discussed in greater detail above, has a bottom portion defined by the enclosing bottom member 52, and sidewalls defined by the bumper member 54. When the lining 74 is included in the convertible pillow system 50, however, the bottom of the enclosed area 56 is defined by the lining overlying the enclosing bottom member 52.

Those skilled in the art will also appreciate that the lining 74 may be readily removable from the bumper member 54. Accordingly, the lining 74 may be detachably connected to the bumper member 54 using snap fasteners, buttons, hook and loop fasteners, or any other type of fastener suitable for detachably connecting the lining to the bumper member. It is preferable that the connection between the lining 74 and the enclosing bottom member 54 is hidden so as not to interfere with an infant while positioned within the enclosed area 56.

The convertible pillow system 50 may also include a pocket 76 carried by the enclosing bottom member 52. The pocket 76 may be positioned along an interior portion of the pillow 58 when the enclosing bottom member 52 is in the folded position. In other words, the pocket 76 may be positioned on the enclosing bottom member 54 so that it is covered by the lining 74 when the second portion of the bumper member 62 is connected to the enclosing the bottom member. Those skilled in the artwork will appreciate that the pocket 76 may be configured so as not to interfere, or cause any discomfort to the infant when the infant is positioned within the enclosed area 56.

The pocket 76 may include a pocket closure 90. The pocket closure 90 may, be provided by a zipper closure, but those skilled in the art will appreciate that any type of closure is contemplated to achieve the goals of the invention. The pocket closure 90 may also include a flap or other device adapted to be positioned over a top opening in the pocket 76. The flap may include a fastener that matingly engages a side portion of the pocket 76 to thereby close the pocket and secure items therein.

Figure 17:
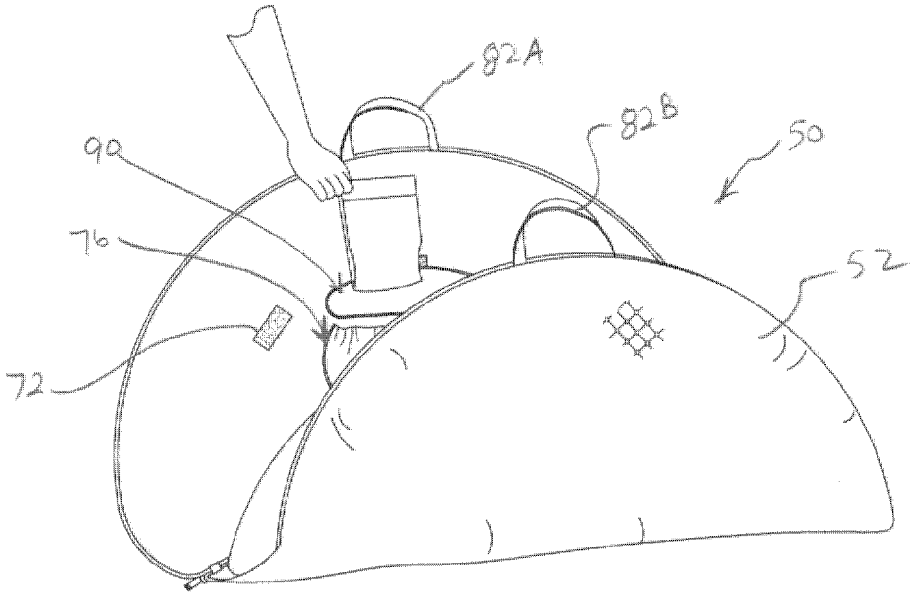
FIG. 17 is perspective view of the convertible pillow system illustrated in FIG. 16 showing use of the pocket.
Figure 18:
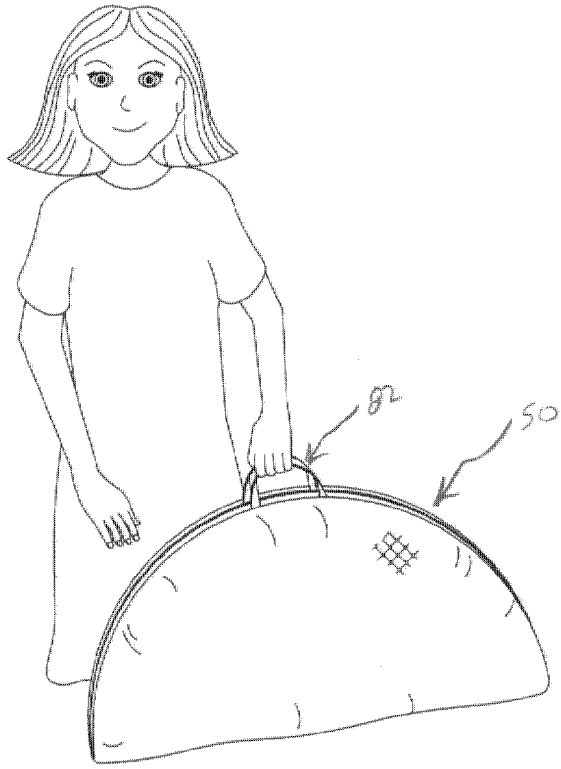
FIG. 18 is an environmental view of the convertible pillow system being transported by a user.

Items associated with infant care, for example, may advantageously be securely stored in the pocket 76. As illustrated, for example, in FIG. 17 items such as diapers, for example, may be positioned within the pocket 76 so that when convertible pillow system 50 is being transported, as illustrated in FIG. 18, for example, the items associated with infant care may be transported therewith. Accordingly, when transporting the convertible pillow system 50, a user may advantageously eliminate the need for excess baggage to carry additional items generally required for infant care.

Referring now back to FIG. 15*a*, an additional aspect of the convertible pillow system 50 is now described in greater detail. The convertible pillow system 50 may also include an auxiliary pillow 78, carried by the enclosing bottom member 52, when the enclosing bottom member is in the folded position. The auxiliary pillow 78 is removable when the enclosing bottom member 52 is in the unfolded position. The auxiliary pillow 78 is removable when the enclosing bottom member 52 is in the unfolded position.

The auxiliary pillow 78 advantageously enhances use of the convertible pillow system 50. For example, the auxiliary pillow 78 may be used for additional support for an infant when using the convertible pillow system 50 as an enclosed area 56. Further, the auxiliary pillow 78 may be used to provide support to an infant when an infant is positioned on his tummy, i.e. "tummy time". The auxiliary pillow 78 may advantageously be nested adjacent the second portion of the bumper member 62 when the second portion of the bumper member is folded adjacent the first portion number 60. Accordingly, when the enclosing bottom member 52 is moved to the folded position, the auxiliary pillow 78 and the bumper member 54 fit within the confines of the folded enclosing bottom member 52.

The convertible pillow system 50 may also illustratively include a closure device 80 connected to the outer peripheral portion of the enclosing bottom member 52. The closure device 80 may, for example, be a zipper closure, and plurality of snap fasteners, or any other type of closure device suitable for securing the enclosing bottom member 52 in the folded position.

The convertible pillow system 50 may also illustratively include a handle 84 fixedly connected to the outer peripheral portion of the enclosing bottom member 52. The handle 84 may be fixedly connected to the enclosing bottom member 52 using a sewn or stitched connection, for example, or any other similar connection. Those skilled in the art will appreciate that any connection that fixedly connects the handle 84 to the enclosing bottom member 52 is contemplated by the present invention.

The handle 84 preferably includes a pair of handle members 84*a*, 84*b* fixedly connected to opposing outer peripheral portions of the enclosing bottom member 52. Accordingly, when the enclosing bottom member 52 is in the folded position, the pair of handle members 84*a*, 84*b* are positioned adjacent one another to form a single handle 84. Further, the handle members 84*a*, 84*b*, are preferably sewn to the enclosing bottom member 52. Those skilled in the art, however, will appreciate that the handle members 84*a*, 84*b* may be fixedly connected to the enclosing bottom member 52 using any other suitable fastening means. The handle 84 advantageously enhances a user's ability to transport the convertible pillow system 50.

Those skilled in the art will appreciate that the convertible pillow system 50 may also be provided without a handle 84. Eliminating the handle 84 of the convertible pillow system 50 may advantageously enhance comfort when being used as a pillow 58.

Figure 19:
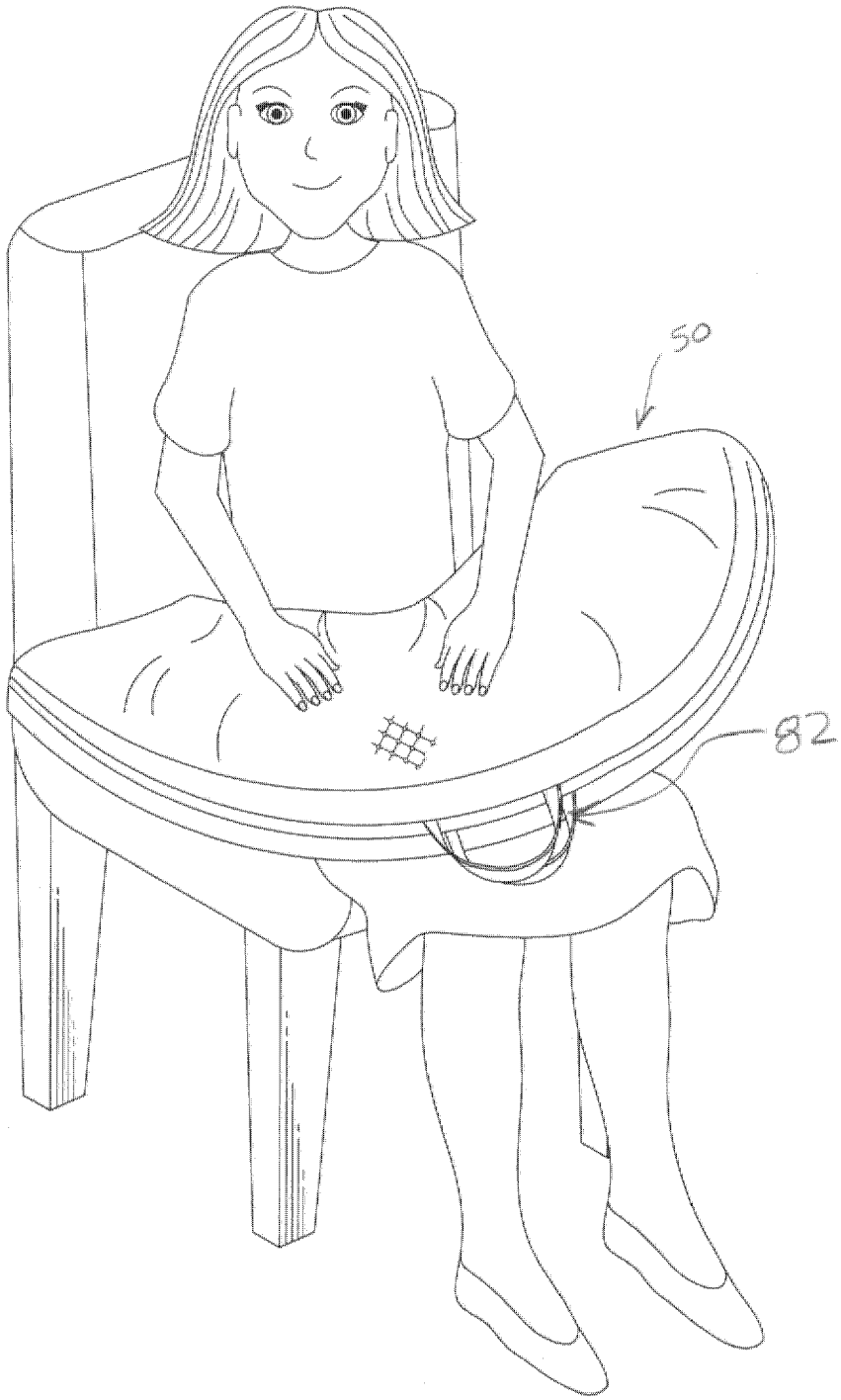
FIG. 19 is an environmental view of the convertible pillow system illustrated in FIG. 18 and being used as a nursing support pillow.

As illustrated in FIG. 19, the pillow 58 of the convertible pillow system 58 of the convertible pillow system 50 may be used as a nursing pillow. For example, the pillow 58 may be positioned over the lap of a mother to support an infant while nursing. This advantageously enhances the comfort of the mother during the nursing process. More specifically, the auxiliary pillow 78 may be removed from within the enclosed area 56 when the enclosing bottom member 52 is in the folded position, and the pillow 58 may be positioned so that the end of the first position of the bumper member 60 and the end of the second portion of the bumper member 62 are adjacent the side portions of the mother's waist. Accordingly, when the auxiliary pillow 78 is removed from within the folded enclosing bottom member 52, the material of the enclosing bottom member may be pushed against the second portion of the bumper member 62 so that the pillow 58 may be comfortably positioned around the mother's waist.

Figure 20:
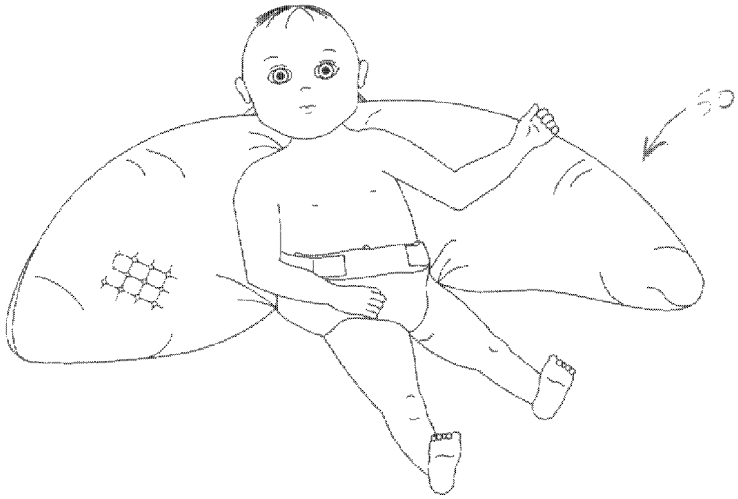
FIG. 20 is an environmental view of the convertible pillow system illustrated in FIG. 18 being used to support an infant.
Figure 21:
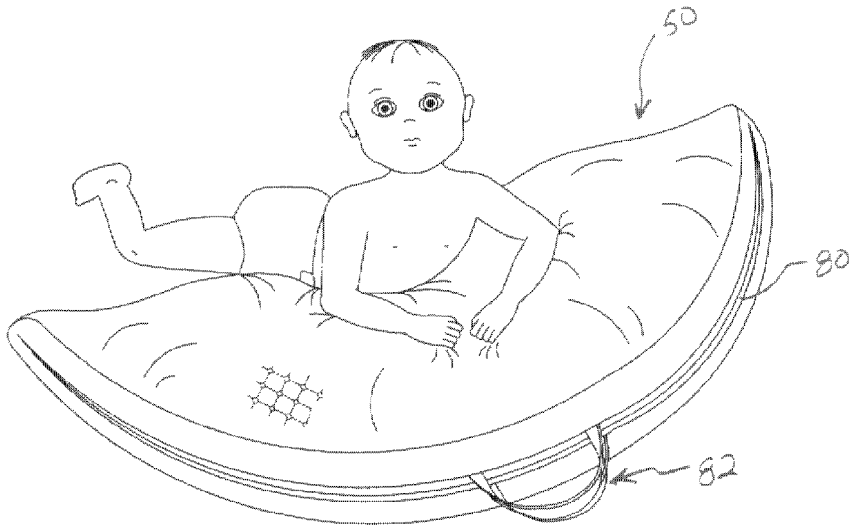
FIG. 21 is an environmental view of the convertible pillow system illustrated in FIG. 18 being used to support an infant.

Referring now additionally to FIGS. 20 and 21, the pillow 58 of the convertible pillow system 50 may be used to provided support to an infant. For example, and as illustrated in FIG. 20, for example, the pillow 58 may be used to assist an infant when sitting up before the infant is able sit up on his own. The pillow 58 in FIG. 20 is illustrated as having the closure device 80 and then handles 82 positioned away from the infant.

Accordingly, the infant may sit back along the end of the folded enclosing bottom member 52 and be supported by the bumper member 54 within the enclosing bottom member. Similar to its use as a nursing pillow, the material of the folded enclosing bottom member 52, may be positioned adjacent the folded bumper member 54 within the folded enclosing bottom member so that the ends of the first portion of the bumper member 60 and second portion of the bumper member 62 are positioned around the body of the infant. As illustrated in FIG. 21, the pillow 58 may be used to support the underside of the infant when the infant is lying on his belly. In other words, the pillow 58 may be used to provide support to the infant when the infant in engaging in "tummy time".

Figure 22:
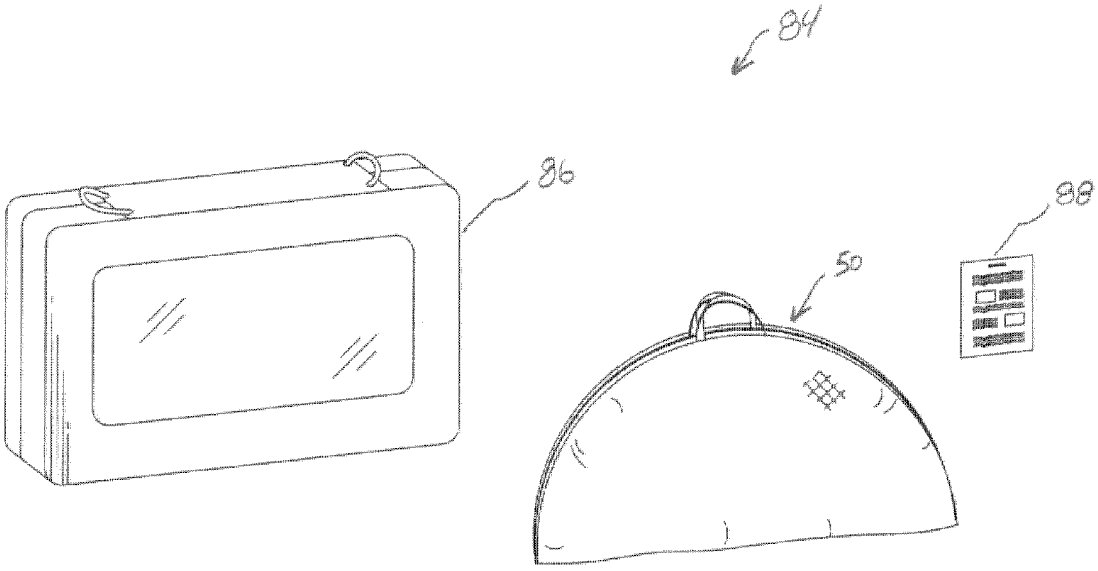
FIG. 22 is a perspective view of a convertible pillow kit according to the present invention.
Figure 23:
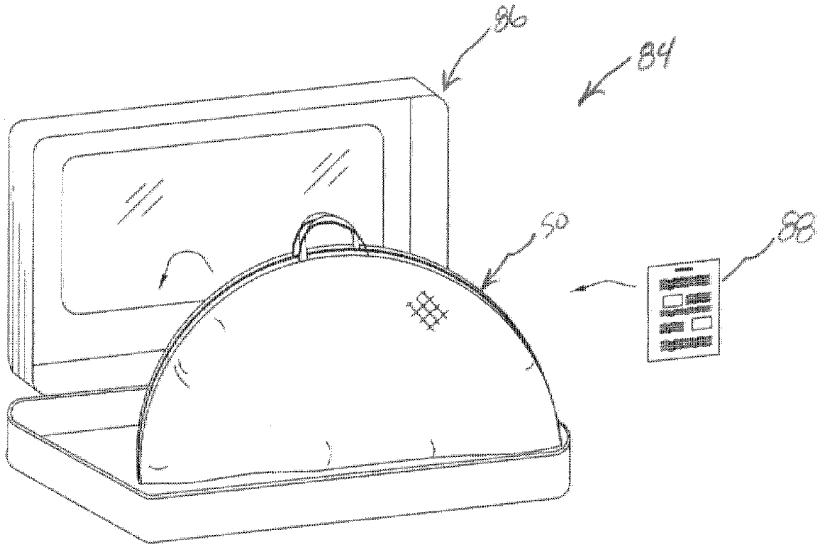
FIG. 23 is another perspective view of the convertible pillow kit illustrated in FIG. 22 and showing the convertible pillow system and printed materials being positioned within a carrying device.

Referring now more specifically to FIGS. 22 and 23, the present invention may also include a convertible pillow kit 84. The convertible pillow kit 84 may include a carrying device 86, a convertible pillow system 50, as discussed in greater detail above, removably carried by the carrying device, and printed material 88 removably carried by the carrying device. The carrying device 86, may, for example, be provided by a box, a bad, or any other device suitable for carrying the convertible pillow system 50 and the printed material 88.

The carrying device 86 is preferably provided by a bad made of plastic material. The bag is preferably substantially transparent and durable. Accordingly, such a bag advantageously protects the contents, i.e., the convertible pillow system 50 and the printed material 88. Those skilled in the art, will appreciate, that the carrying device 86 may be provided by anything suitable for carrying the convertible pillow system 50 and the printed material 88.

The printed material 88, may, for example, having advertising indicia printed thereon, material printed with instructions, or any other typed of printed material, as understood by those skilled in the art. The printed material 88 is preferably viewable through an exterior portion of the carrying device 86. In other words, it is preferable that the carrying device 86 include at least a portion that is substantially transparent so that the printed material 88 may be viewable therethrough.

The convertible pillow system 50 described above is preferably carried within the carrying device. Further, although the carrying device 86 is illustrated as having a rectangular shape, those skilled in the art will appreciate that the carrying device 86 may also have a shape that is similar to the convertible pillow system 50. Accordingly, a carrying device 86 having a substantially semi-circular shape, similar to the preferred semi-circular shape of the convertible pillow system 50 when the enclosing bottom member 52 is in the folded position. This type of shape of the carrying device 86 may advantageously be less bulky and provide for easier transport of the convertible pillow system 50.

A method aspect of the present invention is for using a convertible pillow system 50. The method preferably includes moving the enclosing bottom member 52 from the folded position defining a pillow 58 to an unfolded position defining an enclosed area 56. The method may also include moving the enclosing bottom member 52 from the unfolded position defining the enclosed area 56 to the folded position defining the pillow 58.

Moving the enclosing bottom member 52 from the folded position to the unfolded position includes opening the enclosing bottom member, extending a second portion of the bumper member 62, and connecting the second portion of the bumper member to an outer peripheral portion of the enclosing bottom member. Moving the enclosing bottom member 52 from the unfolded position to the folded position includes detaching the second portion of the bumper member 62 from the outer peripheral portion of the enclosing bottom member, folding the second portion of the bottom member in towards a first portion of the bottom member 60, and folding the enclosing bottom member to overlie the at least bumper member.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A convertible pillow system comprising: an enclosing bottom member moveable between folded and unfolded positions; and at least one bumper member carried by said enclosing bottom member; wherein said enclosing bottom member has a substantially arcuate shape; wherein said enclosing bottom member and said at least one bumper member form an enclosed area when said enclosing bottom member is in the unfolded position, the enclosed area having a bottom defined by said enclosing bottom member and a sidewall defined by said at least one bumper member connected to and overlying outer peripheral portions of said enclosing bottom member; wherein said enclosing bottom member and said at least one bumper member form a pillow when said enclosing bottom member is in the folded position, the pillow having an outer lining portion defined by said enclosing bottom member, and an inner portion defined by said at least one bumper member; and wherein said at least one bumper member comprises a first portion that is fixedly connected to said enclosing bottom member, and a second portion that is detachably connected to said enclosing bottom member.

2. A system according to claim 1 wherein said at least one bumper member is foldable.

3. A system according to claim 1 wherein said at least one bumper member comprises a pair of bumper members joined together by at least one seam.

4. A system according to claim 3 wherein said pair of bumper members comprises a first bumper member having a first predetermined length and a second bumper member having a second predetermined length; and wherein the first predetermined length is longer than the second predetermined length.

5. A system according to claim 1 wherein the substantially arcuate shape of said enclosing bottom member is substantially circular.

6. A system according to claim 1 wherein said at least one bumper member has a substantially circular shape so that the enclosed area is a substantially circular enclosed area.

7. A system according to claim 1 wherein the first portion of said at least one bumper member is fixedly connected to said enclosing bottom member by a stitched connection; and wherein the second portion of said at least one bumper member is detachably connected to said enclosing bottom member by at least one hook and loop fastener.

8. A system according to claim 1 further comprising a lining overlying said enclosing bottom member.

9. A system according to claim 1 further comprising a pocket carried by said enclosing bottom member.

10. A system according to claim 9 wherein said pocket is positioned along an interior of the pillow when said enclosing bottom member is in the folded position.

11. A system according to claim 10 wherein the pocket comprises a pocket closure.

12. A system according to claim 11 wherein the pocket closure is defined by a zipper.

13. A system according to claim 1 further comprising an auxiliary pillow carried by said enclosing bottom member when said enclosing bottom member is in the folded position; and wherein said auxiliary pillow is removable when said enclosing bottom member is in the unfolded position.

14. A system according to claim 1 further comprising a closure device connected to the outer peripheral portion of said enclosing bottom member and moveable between opened and closed positions.

15. A system according to claim 14 wherein the closure device comprises at least one of a zipper and a plurality of snap fasteners.

16. A system according to claim 1 further comprising at least one handle fixedly connected to the outer peripheral portion of said enclosing bottom member.

17. A method of using a convertible pillow system including an enclosing bottom member having a substantially arcuate shape and that is moveable between folded and unfolded positions, and at least one bumper member having a substantially arcuate shape, wherein the at least one bumper member comprises a first portion that is fixedly connected to the enclosing bottom member, and a second portion that is detachably connected to the enclosing bottom member, the method comprising: moving the enclosing bottom member from the folded position defining a pillow to an unfolded position defining an enclosed area; and moving the enclosing bottom member from the unfolded position defining the enclosed area to the folded position defining the pillow; wherein moving the enclosing bottom member from the folded position to the unfolded position includes opening the enclosing bottom member, extending a second portion of the at least one bumper member, and connecting the second portion of the at least one bumper member to an outer peripheral portion of the enclosing bottom member; and wherein moving the enclosing bottom member from the unfolded position to the folded position includes detaching the second portion of the at least one bumper member from the outer peripheral portion of the enclosing bottom member, folding the second portion of the at least one bottom member in towards a first portion of the at least one bottom member, and folding the enclosing bottom member to overlie the at least one bumper member.

18. A method according to claim 17 wherein the at least one bumper member comprises a first bumper member having a first predetermined length and a second bumper member having a second predetermined length, the first and second bumper members being joined together by at least one seam; and wherein the first predetermined length is longer than the second predetermined length.

19. A method according to claim 17 wherein the substantially arcuate shape of the enclosing bottom member is substantially circular; and wherein the at least one bumper member has a substantially circular shape so that the enclosed area is a substantially circular enclosed area.

20. A method according to claim 17 wherein the first portion of the at least one bumper member is fixedly connected to said enclosing bottom member by a stitched connection; and wherein the second portion of the at least one bumper member is detachably connected to said enclosing bottom member by at least one hook and loop fastener.

21. A method according to claim 17 wherein the convertible pillow system further comprises a pocket carried by the enclosing bottom member; and wherein the pocket is positioned along an interior of the pillow when the enclosing bottom member is positioned in the folded position.

22. A method according to claim 21 wherein the pocket comprises a pocket closure defined by a zipper.

23. A method according to claim 17 wherein the convertible pillow system comprises an auxiliary pillow carried by the enclosing bottom member when the enclosing bottom member is in the folded position; and wherein the auxiliary pillow is removable when the enclosing bottom member is in the unfolded position.

24. A method according to claim 17 wherein the convertible pillow system comprises a closure device connected to the outer peripheral portion of the enclosing bottom member and moveable between opened and closed positions; and wherein the closure device comprises at least one of a zipper and a plurality of snap fasteners.

25. A method according to claim 17 wherein the convertible pillow system comprises at least one handle fixedly connected to an outer peripheral portion of the enclosing bottom member.

* * * * *